US006260908B1

(12) United States Patent
Fraula et al.

(10) Patent No.: US 6,260,908 B1
(45) Date of Patent: Jul. 17, 2001

(54) AWNING EXTENSION AND RETRACTION MECHANISM WITH PNEUMATIC ACTUATOR

(75) Inventors: Louis Fraula; Steve L. Fraula, both of Troy, OH (US)

(73) Assignee: White Consolidated Industries, Inc., Cleveland, OH (US)

( * ) Notice: Subject to any disclaimer, the term of this patent is extended or adjusted under 35 U.S.C. 154(b) by 0 days.

(21) Appl. No.: 09/361,717

(22) Filed: Jul. 27, 1999

(51) Int. Cl.[7] ..... E04F 10/06

(52) U.S. Cl. ..... 296/163; 135/88.12; 160/67; 160/71; 160/80

(58) Field of Search ..... 296/163; 160/67, 160/71, 80; 135/88.12, 88.11, 88.1

(56) References Cited

U.S. PATENT DOCUMENTS

| | | | | |
|---|---|---|---|---|
| 3,779,302 | * | 12/1973 | Ackers et al. | 160/68 |
| 3,847,171 | | 11/1974 | Akers et al. . | |
| 3,918,510 | * | 11/1975 | Hayward | 160/45 |
| 3,918,511 | * | 11/1975 | Upton | 160/67 |
| 4,160,458 | | 7/1979 | Marcellus . | |
| 4,576,192 | * | 3/1986 | Duda | 160/67 X |
| 5,148,848 | | 9/1992 | Murray et al. . | |
| 5,368,056 | | 11/1994 | Riggi, Jr. . | |
| 5,597,006 | | 1/1997 | Simonetti . | |
| 5,813,424 | | 9/1998 | Simonetti . | |
| 6,021,835 | * | 2/2000 | Malott | 160/67 |
| 6,029,732 | * | 8/2000 | Malott | 160/67 |
| 6,095,221 | * | 8/2000 | Frey | 160/67 |

* cited by examiner

*Primary Examiner*—Robert Canfield
(74) *Attorney, Agent, or Firm*—Pearne & Gordon LLP

(57) ABSTRACT

A retractable awning assembly includes a spring-biased roller assembly, a flexible canopy having an inner edge for connection to a wall and an outer edge secured to the roller assembly, and a pair of arm assemblies supporting opposite ends of the roller assembly and operable to move the roller assembly between a stored position adjacent the wall and a sheltered position spaced from the wall. Each arm assembly has an extendable support arm, a pneumatic cylinder operably connected to the support arm for extending and retracting the support arm, and an extendable rafter arm including a pair of parallel pneumatic cylinders for extending and retracting the rafter arm. The support arm has a pair of laterally spaced apart wheels which are rotatable about a generally horizontal axis, an upper end operably connected to the roller assembly and a lower end pivotably securable to the wall. The rafter arm has an upper end pivotably securable to the wall and a lower end pivotally connected to the support arm. The awning assembly also includes a pair of laterally spaced apart ramps for each support arm and a pneumatic control system for selectively supplying and exhausting pressurized fluid to and from the pneumatic cylinders of the support arms and the pairs of pneumatic cylinders of the rafter arms to move the roller assembly between the stored position and the sheltered position. The ramps are securable to the wall and have engagement surfaces adapted to cooperate with the wheels of the support arms to pivot the support arms about their lower ends when the support arms are extended while in the stored position.

30 Claims, 6 Drawing Sheets

FIG. 4
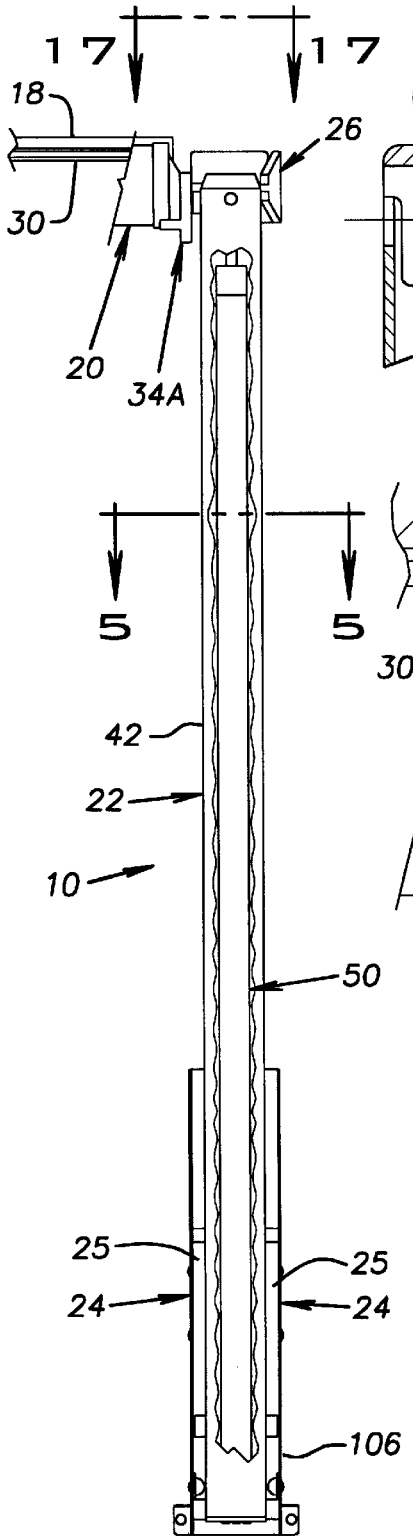
FIG. 6
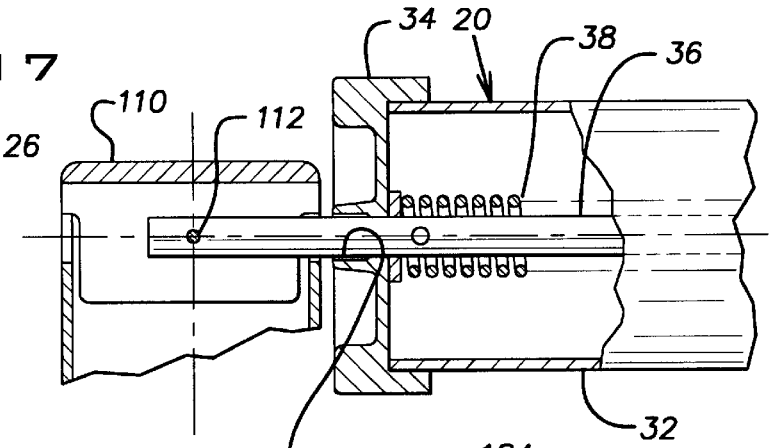
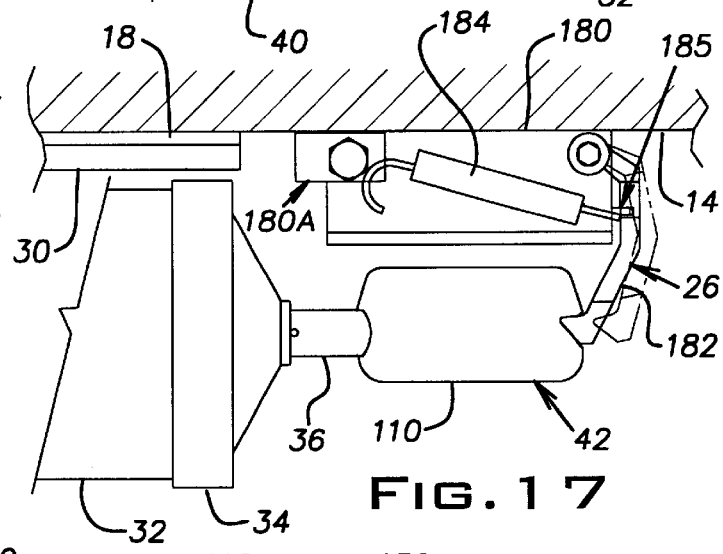
FIG. 17
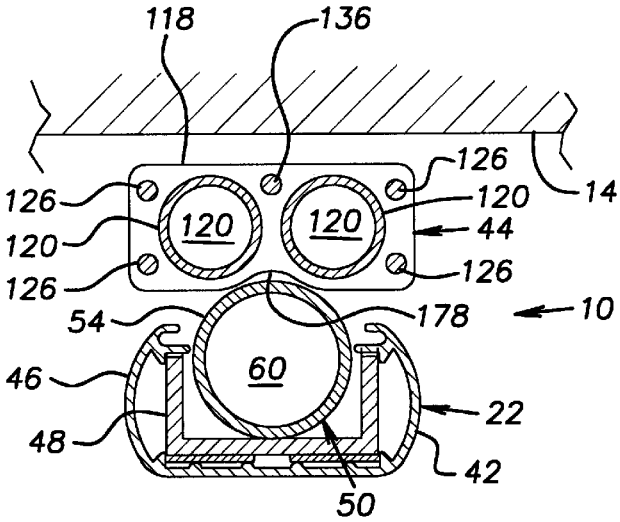
FIG. 5

FIG. 7
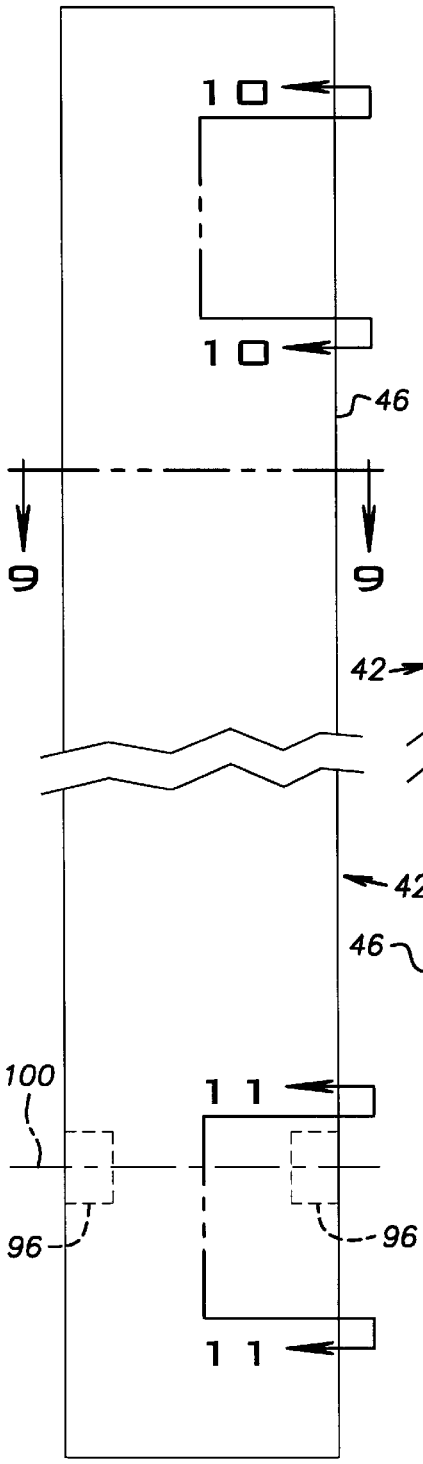
FIG. 8
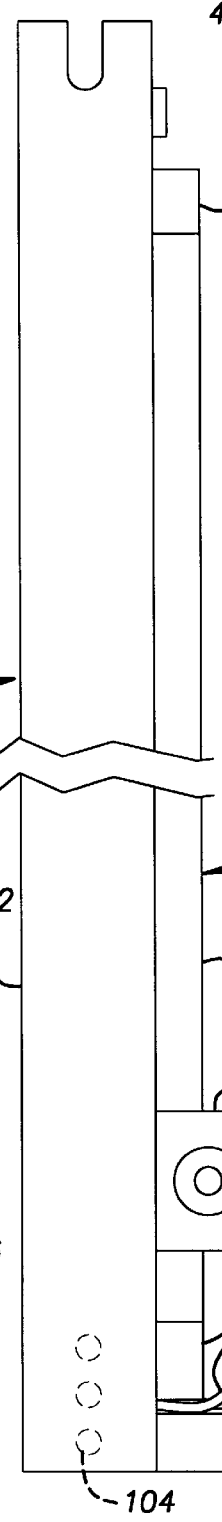
FIG. 9
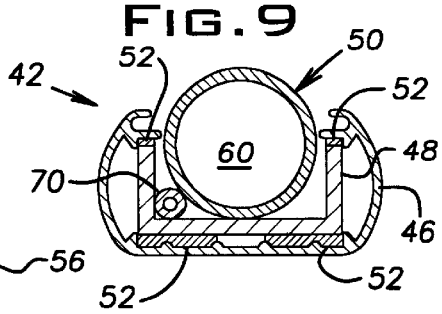
FIG. 10
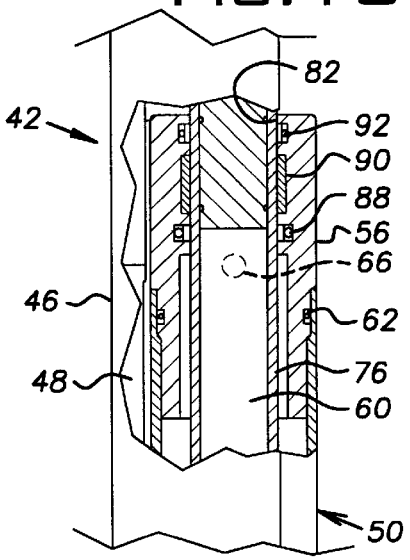
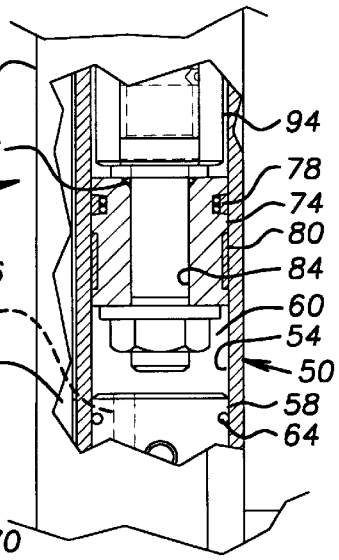
FIG. 11

FIG. 12
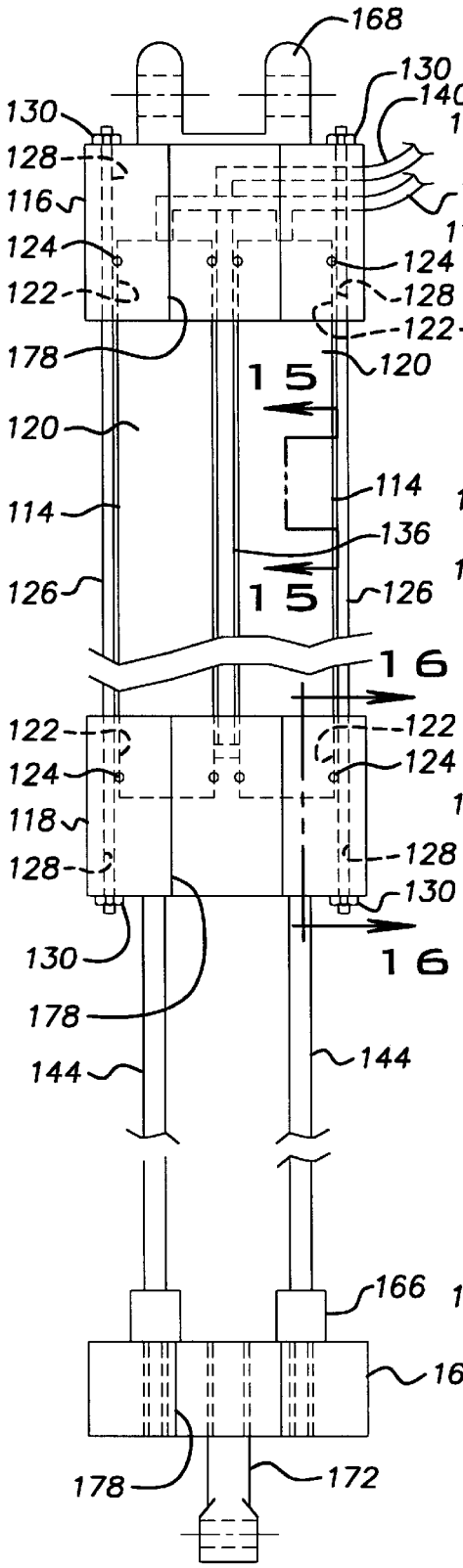
FIG. 13
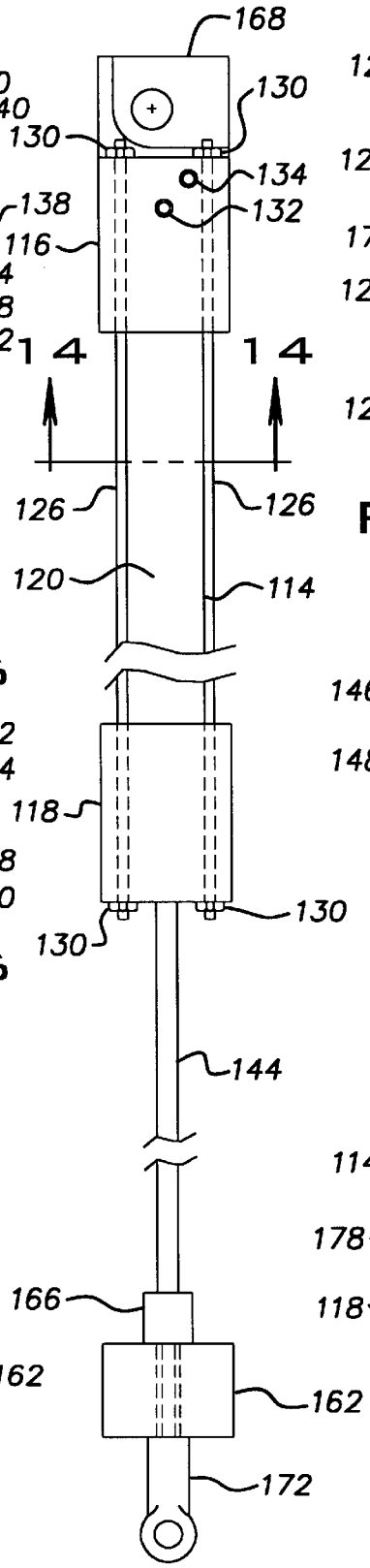
FIG. 14
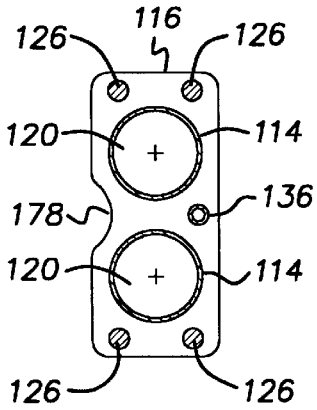
FIG. 15
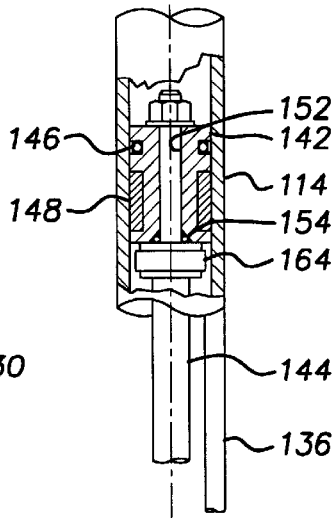
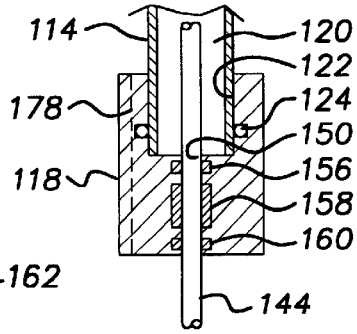
FIG. 16

AWNING EXTENSION AND RETRACTION MECHANISM WITH PNEUMATIC ACTUATOR

BACKGROUND OF THE INVENTION

The present invention generally relates to retractable awnings of the type to be mounted to a substantially vertical support surface and, more specifically, to such awnings which have powered automatic operation with programmable controls.

There are a number of known retractable awnings that support an awning or canopy to create a sheltered area. An inner end of the canopy is typically secured to a wall and an outer end of the canopy is typically secured to a roller assembly. The roller assembly is supported at its ends by support arms for movement between a retracted position, wherein the roller assembly is disposed adjacent the wall, and an extended position, wherein the roller assembly is extended out away from the wall. When the roller assembly is in the retracted position, the canopy is rolled-up on the roller assembly. When the roller assembly is in the extended position, the canopy is unrolled from the roller assembly and extends between the wall and the roller assembly. These retractable awnings are often designed for use with movable support structures such as, for example, recreational vehicles, travel trailers, mobile homes, and the like, but are also usable with fixed support structures. In each case, mobile and stationary support structures, it is important to prevent rain and water accumulation on the fully extended canopy. Therefore, means for running rain water off of the canopy by manually lowering one support arm is normally provided.

While these prior awning assemblies may adequately perform their intended functions, they are often difficult to deploy and retract due to their heavy weight, complex operation and numerous operational steps, particularly for individuals with some physical strength restriction, physically challenged individuals of all ages, and/or individuals with physical coordination at issue. To help all individuals and especially those with some physical restrictions, automatic awnings and assisted manual awnings have been developed. See, for example, U.S. Pat. Nos. 5,813,424, 5,597,006, 4,160,458, and 3,847,171, which each disclose powered mechanisms for automatically operating a retractable awning. While these mechanisms may some what improve operation, they are still relatively difficult to operate, difficult and expensive to manufacture or repair, and/or have demonstrated reliability deficiencies while in the field service environment. Accordingly, there is a need in the art for an improved retractable awning having powered automatic operation with simple to use operating controls which are adaptable for most physically challenged individuals.

BRIEF SUMMARY OF THE INVENTION

The present invention provides a retractable awning assembly which overcomes at least some of the above-noted problems of the related art. According to the present invention, the retractable awning assembly includes a roller assembly, a flexible canopy having an inner edge for connection to the wall and an outer edge secured to the roller assembly, and a pair of arm assemblies supporting opposite ends of the roller assembly and operable to move the roller assembly between a stored position adjacent the wall and a sheltered position spaced from the wall. Each of the arm assemblies have an extendable support arm, a actuator operably connected to the support arm for extending and retracting the support arm, and an extendable rafter arm. The support arm has at least one cam follower, an upper end operably connected to the roller assembly and a lower end pivotably securable to the wall. The rafter arm has an upper end pivotably securable to the wall and a lower end pivotally connected to the support arm. The awning assembly also includes at least one ramp having a cam surface adapted to cooperate with the cam follower to pivot the support arm about the lower end of the support arm when the support arm is extended from the stored position and a control system for selectively supplying power to the actuator to move the roller assembly between the stored position and the sheltered position.

According to another aspect of the present invention, a retractable awning assembly includes a roller assembly, a flexible canopy having an inner edge for connection to a wall and an outer edge secured to the roller assembly, and a pair of arm assemblies supporting opposite ends of the roller assembly and operable to move the roller assembly between a stored position adjacent the wall and a sheltered position spaced from the wall. Each of the arm assemblies have an extendable support arm, a powered actuator operably connected to the support arm for extending and retracting the support arm, and an extendable rafter arm including a pair of parallel powered actuators for extending and retracting the rafter arm. The support arm has an upper end operably connected to the roller assembly and a lower end pivotably securable to the wall. The rafter arm has an upper end pivotably securable to the wall and a lower end pivotally connected to the support arm. The awning assembly also includes a control system for selectively supplying power to the actuator of the support arm and the pair of actuators of the rafter arm to move the roller assembly between the stored position and the sheltered position.

According to yet another aspect of the present invention, a method of deploying a retractable awning includes the steps of extending the support arms until the support arms are fully extended, and retracting the rafter arms until the support arms are fully extended and extending the rafter arms after the support arms are fully extended.

BRIEF DESCRIPTION OF THE SEVERAL VIEWS OF THE DRAWING

These and further features of the present invention will be apparent with reference to the following description and drawings, wherein:

FIG. 4 is a front elevational view of a right support arm assembly of the awning assembly (FIG. 1) showing an awning roll assembly attachment section;

FIG. 5 is a cross-section view taken along line 5—5 of FIG. 4;

FIG. 6 is an enlarged cross-section view showing a connection between an awning roll and a support arm assembly;

FIG. 7 is a front elevational view of a support arm of the awning assembly (FIG. 1);

FIG. 8 is a side elevational view of the support arm (FIG. 7);

FIG. 9 is a cross-section view taken along line 9—9 of FIG. 7;

FIG. 10 is an enlarged cross-section view taken from line 10—10 of FIG. 7;

FIG. 11 is an enlarged cross-section view taken from line 11—11 of FIG. 7;

FIG. 12 is a front elevational view of a rafter assembly of the awning assembly (FIG. 1);

FIG. 13 is a side elevational view of the rafter assembly (FIG. 12);

FIG. 14 is a cross-section view taken along line 14—14 of FIG. 13;

FIG. 15 is an enlarged cross-section view taken from line 15—15 of FIG. 12;

FIG. 16 is a cross-section view taken from line 16—16 of FIG. 12;

FIG. 17 is an enlarged fragmented top plan view taken from line 17—17 of FIG. 4 showing a lock mechanism.

DETAILED DESCRIPTION OF PREFERRED EMBODIMENTS

FIGS. 1 to 5 illustrate a retractable awning assembly 10 according to the present invention which is mounted to a recreational vehicle 12 at a vertical support surface such as an exterior side wall 14. The term "recreational vehicle", as used in the specification and claims, includes campers, travel trailers, mobile homes, vans, and the like. It is noted, however, that the awning assembly 10 can be mounted adjacent any vertically-extending support wall whether it is a moving structure such as a vehicle or a static structure such as a building.

Figure 2:
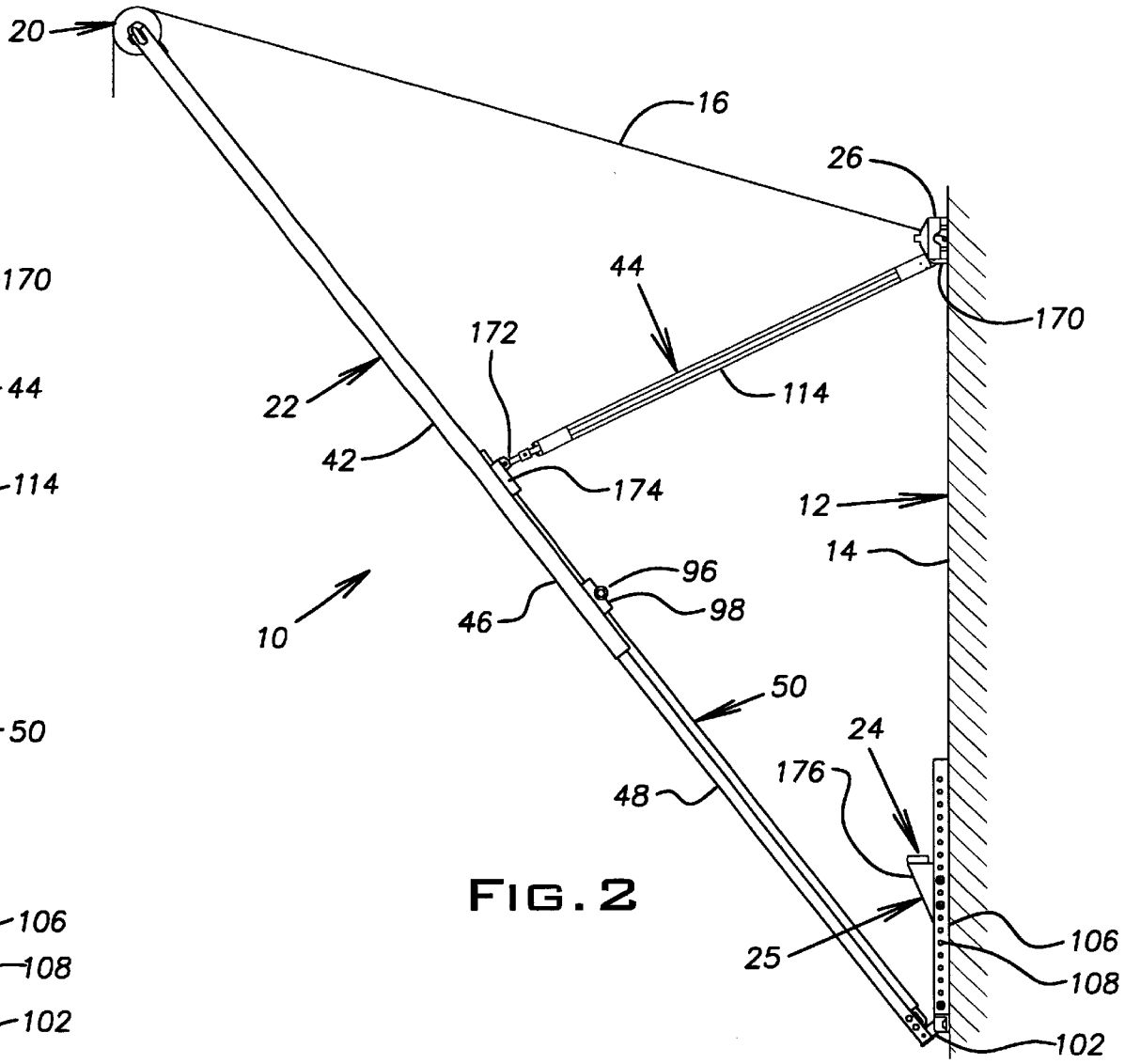
FIG. 2 is a side elevational view of the awning assembly (FIG. 1) in a partially extended position.
Figure 1:
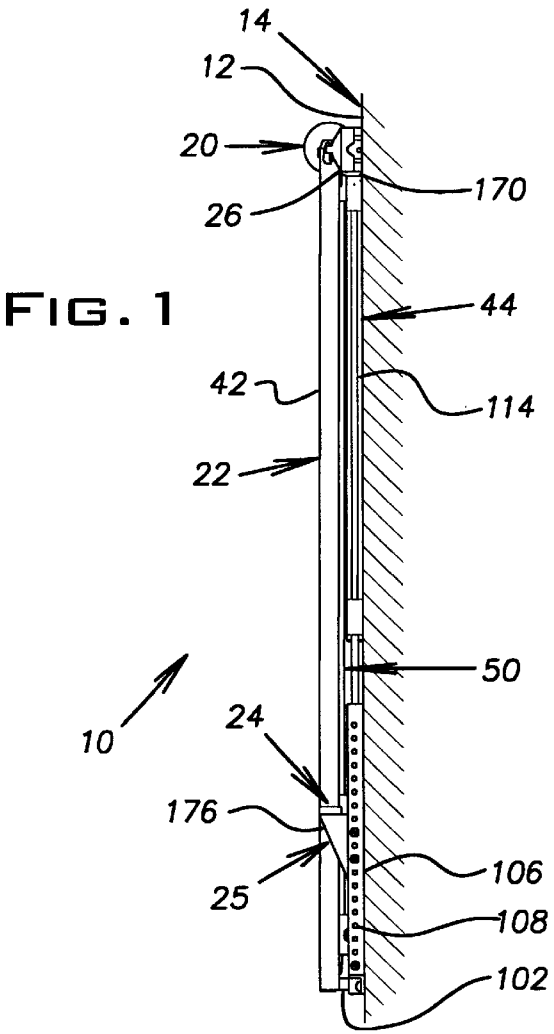
FIG. 1 is a side elevational view of an awning assembly in a retracted position.
Figure 3:
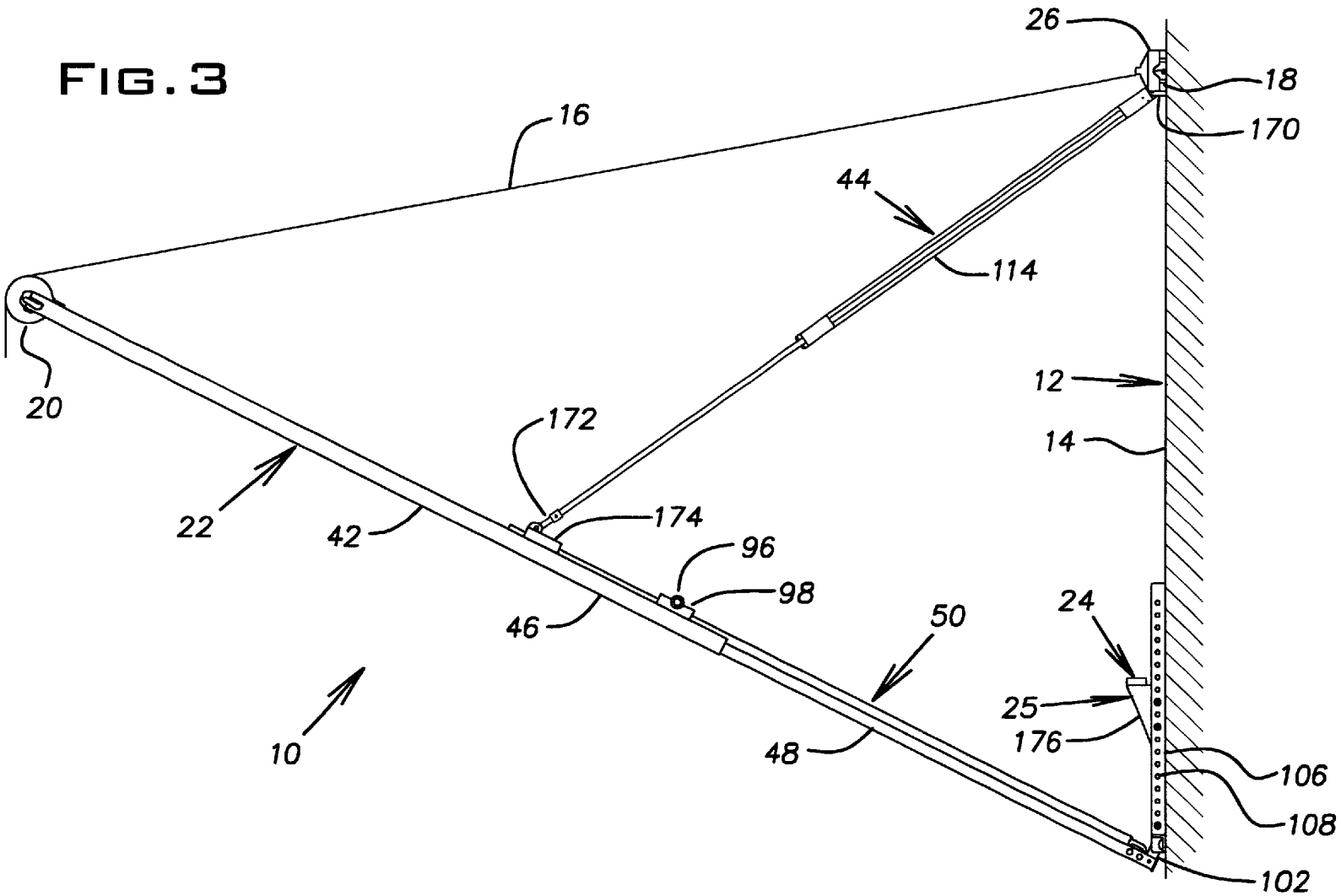
FIG. 3 is a side elevational view of the awning assembly (FIG. 1) in a fully extended position.

As best shown in FIGS. 1–3, the awning assembly 10 is operable between a retracted or stored position (shown in FIG. 1) and an extended or sheltered position (shown in FIG. 3). In the retracted position, the awning assembly 10 is in a compact configuration close to the side wall 14 of the recreational vehicle 12 so that the recreational vehicle 12 can travel to desired destinations (best seen in FIG. 5). After a destination is reached, the awning assembly 10 is deployed from the retracted position to the extended position if a covered area adjacent the recreational vehicle 12 is desired to protect against sun, rain, and the like.

The awning assembly 10 includes an awning or canopy 16 for selectively covering an area adjacent to the recreational vehicle 12 (FIG. 3), an awning or header rail 18 (FIG. 17) securing the canopy 16 (FIG. 3) to the side wall 14, a roller assembly 20 (FIG. 3) for furling and unfurling the canopy 16, a pair of arm assemblies 22 for supporting opposite ends of the roller assembly 20 and moving the roller assembly 20 between the retracted and extended positions, adjustable mounting brackets 24 with ramps 25 secured to the recreational vehicle side wall 14 for guiding the arm assemblies 22 away from the side wall 14, a lock mechanism 26 (FIG. 4) for securing the arm assemblies 22 in the retracted position, and a control system 28 (FIG. 18) such as the illustrated pneumatic control system for automatically moving the arm assemblies 22 between the retracted and extended positions.

The canopy 16 (FIG. 3), is a sheet of flexible material such as, for example, fabric, canvas, or nylon and is preferably rectangularly shaped. The inner edge of the canopy 16 is secured to the awning rail 18 and the outer edge of the canopy 16 is secured to the roller assembly 20. The inner and outer edges of the canopy 16 are preferably provided with ropes as is known in the art. The awning ropes are preferably polypropylene ropes and are mounted in a hems or pockets formed at the inner and outer edges of the canopy 16.

As best shown in FIGS. 3 and 4, the awning rail 18 horizontally extends along the side wall 14 of the recreational vehicle 12 at an elevated position and is rigidly secured thereto by suitable fasteners. The awning rail 18 is preferably an extrusion and more preferably an aluminum extrusion. The awning rail 18 preferably has a length slightly longer than the width of the canopy 16 and slightly shorter than the width between the arm assemblies 22. The awning rail 18 preferably has an awning rope retainer 30 which is generally C-shaped in cross-section forming a longitudinally extending channel. In cross-section, the channel has a longitudinally extending, circular-shaped opening and a longitudinally extending slot at a forward or outward side of the opening. The awning rope at the inner edge of the canopy 16 is contained in the rope retainer 30 with the canopy 16 extending through the slot to secure the inner edge of the canopy 16 to the awning rail 18 and the side wall 14.

As best shown in FIG. 6, the roller assembly 20 preferably includes a hollow roller tube 32, a pair of end caps 34 closing the open ends of the roller tube 32, shafts or bars 36 which rotatably support the roller tube 32, and a torsion spring 38 which rotatingly biases the roller tube 32. Each end cap 34 is rigidly secured to the roller tube 32 for rotation therewith and has a central opening 40. The bar 36 extends through the central opening 40 such that the roller tube 32 and the end cap 34 are free to rotate together with respect to the bar 36. The torsion spring 38 is disposed around the bar 36 within the roller tube 32. The spring 38 is operably connected between the roller tube 32 and the bar 36 in any known manner so that rotation of the roller tube 32 with respect to the bar 36 varies tension of the spring 38. The torsion spring 38, therefore, is preloaded for biasing the roller tube 32 to roll-up the canopy 16 onto the roller tube 32. If desired, the roller assembly 20 can further include known lock mechanisms to selectively prevent rotation of the roller tube 32 in one direction or the other or both directions. Such a lock mechanism can be particularly useful to prevent the furled canopy from billowing when in the stored position. See for example, U.S. Pat. No. 5,732,756, the disclosure of which is expressly incorporated herein by reference in its entirety, disclosing a suitable lock mechanism. Preferably the awning anti-billowing feature becomes effective automatically when the awning is held in the stored position. The awning with a secured appendage 34A (FIG. 4) on the roller end in cooperation with the secured appendage 180A (FIG. 17) on the mounting bracket 184 is configured to limit the awning rotation; providing the anti-billowing feature without the requirement for operator intervention or the need for any additional mechanism.

Each arm assembly 22 is disposed in a generally vertical plane at an associated side edge of the canopy 16 and an associated end of the roller assembly 20. Each arm assembly 22 preferably includes a support arm 42 and a rafter arm 44. The support arm 42 has an upper end connected to the end of the roller assembly 20 and a lower end pivotally connected to the side wall 14. The rafter arm 44 has an outer end operably connected to the support arm 42 and an inner end pivotally connected to the side wall 14 above the lower end of the support arm 42. The support arm 42 and the rafter arm 44 are each preferably formed from a lightweight, high strength material such as, for example, an aluminum alloy.

Each support arm 42 (FIG. 3) includes telescoping outer and inner members 46, 48 to vary the length of the support arm 42 and a powered actuator 50 such as the illustrated pneumatic actuator for moving the outer member 46 relative to the inner member 48. While the powered actuator 50 is preferably a pneumatic cylinder, it can alternatively be another type of fluid cylinder such as a hydraulic cylinder or another type of powered actuator such as an electric linear actuator. The outer member 46, which is preferably disposed at the upper end of the support arm 42, has a sliding relationship with the inner member 48.

As best shown in FIGS. 7–11, the outer member 46 of the support arm 42 is preferably U-shaped in cross-section and forms a channel which extends along the entire length of the outer member 46. The inner member 48 of the support arm 42 is sized and shaped for insertion into the channel of the outer member 46 so that the outer member 46 slides along the inner member to vary the length of the support arm 42. The inner member 48 is also preferably U-shaped in cross section and forms a channel which extends along the entire length of the inner member 48. Preferably, bearing material or pads 52 (FIG. 9) comprising a low-friction material such as, for example, TEFLON$^R$ are provided at areas of engagement between the inner and outer members 46, 48 to reduce resistance to sliding movement therebetween.

The pneumatic actuator 50 (FIGS. 8 and 9) is mounted within the channel of the inner member 48 and includes a hollow cylinder 54 with upper and lower end caps 56, 58 closing ends of the cylinder 54 to form a sealed interior space or chamber 60 within the cylinder 54. The upper and lower end caps 56, 58 are each provided with a suitable seal 62, 64 for sealing the end caps 56, 58 to the cylinder 54 and a port 66, 68 for providing fluid flow communication with the respective ends of the sealed interior chamber 60. Fluid tubes or lines 70, 72 of the control system 28 are connected to the upper and lower ports 66, 68 respectively as described in more detail hereinafter.

The pneumatic actuator 50 (FIG. 11) also includes a piston 74 within the sealed interior chamber 60 for axial movement therein and a rod assembly 76 (FIG. 10) rigidly secured to the piston 74 for movement therewith. The piston 74 sealingly engages the interior wall of the cylinder 54 to divide the interior chamber 60 into upper and lower portions: the upper port 66 being in communication with the upper portion and the lower port 68 being in communication with the lower portion. The piston 74 is preferably provided with a suitable seal 78 for sealing the piston 74 to the wall of the cylinder 54 and a suitable bearing material 80 for reducing frictional resistance to movement of the piston 74 within the cylinder 54.

The lower end of the rod assembly 76 (FIGS. 10 and 11) is rigidly secured to the piston 74 in a suitable manner and axially extends from an upper end of the piston 74 and through an opening 82 in the upper end cap 56. The illustrated rod assembly 76 extends through a central opening 84 in the piston 74 (FIG. 11) and the piston 74 is provided with a suitable seal 86 to seal the central opening 84. The upper end cap 56 is preferably provided with a suitable seal 88 for sealing the rod assembly 76 to the upper end cap 56 and a suitable bearing member 90 for reducing frictional resistance to movement of the rod assembly 76 within the upper end cap 56. The upper end cap 56 is also preferably provided with a suitable scraper 92 axially outward of the seal 88 and the bearing member 90 for removing any debris or contaminants from the surface of the rod assembly 76 to prevent damage to the seal 88 and the bearing member 90. A spacer 94 is preferably located on the rod assembly 76 adjacent the piston 74.

The upper and lower end caps 56, 58 are rigidly connected to the inner member 48 with suitable fittings while the upper end of the rod assembly 76 is rigidly connected to the outer member 46 with suitable fittings. From the above description, it can be seen that the length of the support arm 42 is varied by selectively supplying pressurized fluid to and venting fluid from opposite sides of the piston 74 via the upper and lower ports 66, 68 and the fluid lines 70, 72.

A pair of transversely-spaced apart cam followers or wheels 96 (FIGS. 7 and 8) are secured to a lower end of the outer member 46. The wheels 96 are mounted to a bracket 98 such that they are rotatable about a transversely extending axis 100. The bracket 98 is rigidly secured to the lower end of the outer member 46 so that the wheels 96 cooperate with the ramps 25 (FIG. 3) as described in more detail hereinafter.

The bottom end of the support arm 42 is pivotally connected to the side wall 14 (FIG. 3) beneath the awning rail 18 at a relatively low position. The bottom of the support arm inner member 48 is provided with an end cap or foot member 102. The foot member 102 is secured to the support arm inner member 48 by a suitable fastener 104 such as, the illustrated bolt. As best shown in FIGS. 1–4, the foot member 102 is pivotally attached to a lower attachment or bracket 106.

The lower bracket 106 (FIGS. 1, 2 and 3) is rigidly secured to the bottom of the side wall 14. The lower bracket 106 is provided with a plurality of spaced-apart openings 108 for locating the adjustable mounting bracket 24 at the desired height. The adjustable mounting bracket 24 is preferably adjustable relative to the lower bracket 106 and the side wall 14, thereby accommodating, recreational vehicles 12 with side walls 14 of different heights. Foot member 102 is securely attached to the lower end of the support arm 42 and pivotally connected to the adjustable mounting bracket 24. By fastening the foot member 102 to the adjustable mounting bracket 24, the effective height of the awning assembly 10 is adjusted to match the height of the side wall 14.

As best shown in FIGS. 4, 5 and 6, the top end of the support arm 42 is secured to and supports the roller assembly 20. The top of the support arm outer member 46 is preferably provided with an end cap 110. The end cap 110 is preferably a metal casting and is rigidly secured to the support arm outer member 46 by a suitable fastener. The shaft 36 of the roller assembly 20 extends into the end cap 110 and is preferably secured thereto with provisions for limited rotation, in one plane, by a pin 112 or other suitable means.

As best shown in FIGS. 12–16, each rafter arm 44 includes first and second parallel powered actuators such as the illustrated pneumatic actuators. While the powered actuators are preferably pneumatic cylinders, they can alternatively can be another type of fluid cylinder such as a hydraulic cylinder or another type of powered actuator such as an electric linear actuator. The illustrated first and second pneumatic actuators include parallel first and second pneumatic cylinders 114 and upper and lower cylinder caps 116, 118 closing ends of the cylinders 114 to form first and second sealed interior spaces or chambers 120 within the cylinders 114. The upper and lower cylinder caps 116, 118 are each provided with a pair of blind bores 122 for closely receiving ends of the cylinders 114 and a suitable seal 124 for sealing the cylinder caps 116, 118 to the cylinders 114. Clamping rods 126 and suitable fasteners are provided to clamp the upper and lower cylinder caps 116, 118 together with the cylinders 114 therebetween. In the illustrated embodiment, the clamping rods 126 extend through openings 128 in the cylinder caps 116, 118 and have threaded ends secured with cooperating nuts 130.

The rafter arm upper cylinder cap 116 is provided with lower and upper ports 132, 134 for providing fluid-flow communication with respective ends of the sealed interior chambers 120. The lower port 132 is connected to the upper or inner ends of the cylinders 114 by a passage in the upper cylinder cap 116. The upper port 134 is connected to the lower or outer end of the cylinders 114 by a passage in the upper cylinder cap 116, a fluid line or tube 136 connecting the upper and lower cylinder caps 116, 118, and a passage within the lower cylinder cap 118. Fluid lines or tubes 138, 140 of the control system 28 are connected to the upper and lower ports 134, 132 respectively as described in more detail hereinafter.

The rafter arm 44 also includes first and second pistons 142 within the first and second interior chambers 120 respectively for axial movement therein and first and second rods 144 rigidly secured to the first and second pistons 142 respectively for movement therewith. Each piston 142 sealingly engages the interior wall of the associated cylinder 114 to divide the associated interior chamber 120 into upper and lower portions: the lower port 132 being in communication with the upper portion and the upper port 134 being in communication with the lower portion. Each piston 142 is preferably provided with a suitable seal 146 for sealing the piston 142 to the wall of the cylinder 114 and a suitable bearing material 148 for reducing wear and frictional resistance to movement of the piston 142 within the cylinder 114.

The upper ends of the rods 144 are rigidly secured to the pistons 142 in a suitable manner and axially extend from the lower ends of the piston 142 and through openings 150 in the lower cylinder cap 118. The illustrated rods 144 extend through central openings 152 in the pistons 142 and each piston 142 is provided with a suitable seal 154 to seal the central opening 152. The lower cylinder cap 118 is preferably provided with suitable seals 156 for sealing the rods 144 to the lower cylinder cap 118 and suitable bearing material 158 for reducing wear and frictional resistance to movement of the rods 144 within the lower cylinder cap 118. The lower cylinder cap 118 is also preferably provided with suitable scrapers 160 axially outward of the seals 156 for removing any debris or contaminants from the surface of the rods 144 to prevent damage to the seals 156 and the bearing members 158. A rod fitting 162 rigidly connects the lower end of the rods 144 so that the rods 144 and the pistons 142 axially move together. Piston stops 164 are preferably located adjacent the lower ends of the pistons 142 to limit downward movement of the pistons and rods 142, 144. Rod stops 166 are preferably located at the lower ends of the rods 144 adjacent the rod fitting 162 to limit upward movement of the pistons and rods 142, 144. From the above description, it can be seen that the length of the rafter arm 44 is varied by selectively supplying pressurized fluid to and venting fluid from opposite sides of the pistons 142 via the upper and lower ports 134, 132 and the fluid lines 138, 140.

The top end of the rafter arm 44 (FIG. 3) is pivotally connected to the side wall 14 near the awning rail 18. The upper cylinder cap 116 is provided with a pivot member 168 (FIGS. 12 and 13). As best shown in FIGS. 1–3, the pivot member 168 is pivotally attached to an upper attachment or bracket 170. The upper bracket 170 is rigidly secured to the side wall 14.

As best shown in FIGS. 1–3 and 12–13, the bottom end of the rafter arm 44 is pivotally connected to the support arm 42 near the lower end of the outer member 46. The rod fitting 162 is provided with a pivot member 172. The pivot member 172 is pivotally attached to a rafter attachment or bracket 174. The rafter bracket 174 is rigidly secured to a fixed axial position on the outer member 46 of the support arm 42.

As best shown in FIGS. 1–4, the adjustable mounting brackets 24 are secured in accordance with the side wall 14 height requirements and the ramps 25 cooperate with the wheels 96 to guide the support arms 42 outwardly from the side wall during deployment of the awning assembly 10. In the illustrated embodiment, the adjustable mounting brackets 24 are secured to the lower brackets 106 and their vertical location can be adjusted by mounting them to different openings 108 in the lower bracket 106. Preferably there are two ramps 25 associated with each support arm 42 so that there is a separate ramp 25 cooperating with each of the wheels 96. The ramps 25 are laterally spaced apart so that the support arm 42 can vertically extend therebetween. Each ramp 25 has a camming or engagement surface 176 which is sized and shaped to cooperate with the wheels 96 to pivot the support arms 42 about their lower end when the support arms 42 are lengthened while in the retracted position as will be described in more detail hereinafter. In the illustrated embodiment, the ramps 25 are generally "wedge shaped" wherein the distance between the engagement surface 176 and the side wall 14 increases as the wheel 96 travels from the lower end of the ramp 25 to the upper end of the ramp 25.

As best shown in FIGS. 1 and 5, the support arms 42 and the rafter arms 44 have a substantially parallel relationship with the side wall 14 of the recreational vehicle 12 when the awning assembly 10 is in the stored position. In order to achieve an even more compact profile in the stored position, the rafter arms 44 are preferably conform with the pneumatic actuator 50 of the support arm 42. In the illustrated embodiment, the upper and lower cylinder caps 116, 118 and the rod fittings 162 are provided with grooves or channels 178 for partly receiving the pneumatic actuator 50 therein.

As best shown in FIGS. 4 and 17, the automatic lock mechanism 26 is secured to the side wall 14 and is adapted to secure the support arm 42 to the side wall 14 when the awning assembly 10 is in the retracted position. The lock mechanism 26 includes a base 180, a lock member 182 pivotally attached to the base 180, a spring 184 operatively connected to the lock member 182, and a powered actuator such as a pneumatic cylinder 185 (FIG. 18) within the base 180 and operable with the lock member 182. The base 180 is rigidly secured to the side wall 14 with suitable fasteners at a position adjacent the top of the support arm 42 when the support arm 42 is in the retracted position. The lock member 182 has a first end pivotally attached to the base 180 for pivoting motion about a generally vertical axis and a second end adapted to engage the top end of support arm 42 and prevent outward movement of the support arm away from the side wall 14. In the illustrated embodiment, the lock member 182 cooperates with an opening in the end cap 110 and wall of the support arm outer member 46. The lock member 182 is pivotable between a locking position (shown in solid line in FIG. 17) and a disengaged position (shown in phantom line in FIG. 17). The spring 184 biases the lock member 182 to the locking position to enable the lock mechanism 26 to be remain engaged in the locking position when the control system 28 is not powered. The pneumatic cylinder 185 is operably connected to the lock member 182 so that selective operation of the pneumatic cylinder 185 pivots the lock member 182 from the locking position to the disengaged position. The pneumatic cylinder 185 is adapted to pivot the lock member 182 to the disengaged position when pressurized fluid is provided thereto by a fluid line 186 (FIG. 18) of the control system 28.

Figure 18:
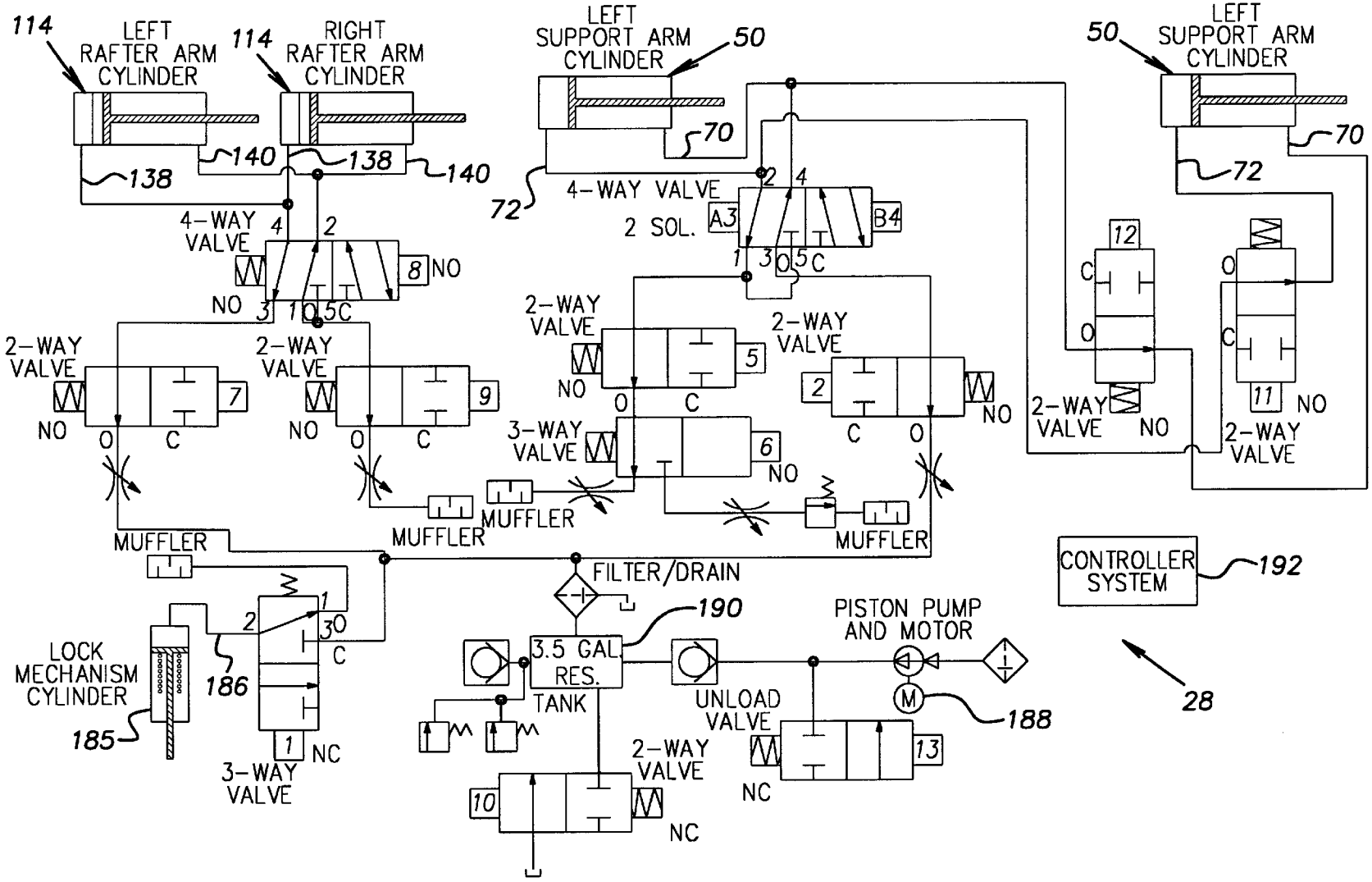
FIG. 18 is a schematic view of a pneumatic control system of the awning assembly (FIG. 1).

As best shown in FIG. 18, the control system 28 includes a piston pump and motor 188 for pressurizing fluid, a reservoir 190 for storing pressurized fluid, and a plurality of valves for selectively operating the various pneumatic actuators of the awning assembly 10. The control system 28 also includes a controller 192 in communication with the solenoid valves for selective operation thereof as described in more detail hereinbelow. It is noted that while the preferred control system 28 for use with pneumatic actuators is shown herein, other alternative systems apparent to those skilled in the art may be utilized. Additionally, control systems for use with other types of actuators such as hydraulic actuators and/or electric linear actuators apparent to those skilled in the art may be utilized.

To automatically move the awning assembly 10 to the sheltered position from the stored position, the operator simply initiates an opening operation by inputting an extension command to the control system 28. The control system 28 supplies pressurized fluid to the pneumatic cylinder 185 of the lock mechanism 26 so that the lock member 182 is pivoted to the disengaged position. It is noted that control system 28 requires the operator to input an extension command to the control system 28 before the lock mechanism 26 (FIG. 17) releases the roller assembly 20.

Next, pressurized fluid is supplied to the lower ends of the support arm pneumatic actuators 50 to begin expanding or lengthening the support arms 42 and to the lower ends of the rafter arm pneumatic cylinders 114 to maintain the rafter arms 44 in a retracted condition. It is noted that while pressurized fluid is supplied to the lower ends of the pneumatic actuators 50 and 114 (FIGS. 1, 2 and 3), the upper ends of the pneumatic actuators 50 and 114 are open to a controlled exhaust system. As the wheels 96 engage and travel over the ramps 25, the support arms 42 are pivoted outward about their lower ends and the rafter arms 44 are pivoted outward about their upper ends away from the side wall 14. The ramps 25 pivot the support arms 42 out far enough to enable full extension of the support arms 42 while the rafter arms 44 and the torsion springs 38 of the roller assembly 20 restrain the support arms 42 against the influence of gravity. As the support arms 42 outwardly pivot from the side wall, the canopy is unfurled from the roller assembly 20 while increasing the awning roll spring torsion. The support arms 42 continue to be lengthened until they are fully expanded as best shown in FIG. 2.

Once the support arms 42 are fully expanded, pressurized fluid is supplied to the upper end of the rafter arm pneumatic cylinders 114 to begin expanding or lengthening the rafter arms 44. It is noted that while pressurized fluid is supplied to the upper ends of the cylinders 114, the lower ends of the cylinders 114 are open to a controlled exhaust system. As the rafter arms 44 are lengthened, the support arms 42 downwardly pivot about their lower ends. The rafter arms 44 continue to be lengthened until they are fully expanded and the awning assembly is in the fully sheltered position (FIG. 3). The pressurized pneumatic cylinders 50 and 114 hold the awning assembly 10 in the sheltered position.

When in the sheltered position, the operator can selectively move the awning assembly 10 to a rain position to prevent rain water accumulation on the fully extended canopy 16. The operator merely inputs a rain position command to the control system 28 and the control system 28 automatically sets the actuator pressures for lowering and holding one of the arm assemblies 22 so that one end of the roller assembly 20 is lower than the other end. This rain position allows for drainage of rain water off of the canopy 16 before an undesirable amount of water accumulates on top of the canopy 16. Preferably, the arm assembly 22 is lowered by partially retracting the support arm 42. To automatically return to the sheltered position, the operator merely inputs an extension command to the control system 28 and the control system 28 automatically sets the actuator pressures for raising the lowered arm assembly 22 so that the roller assembly 20 is again level.

To automatically move the awning assembly 10 to the stored position from the sheltered position, the operator simply inputs a retraction command to the control system 28. Pressurized fluid is supplied to the lower end of the rafter arm pneumatic cylinders 114 to begin retracting or shortening the rafter arms 42. It is noted that while pressurized fluid is supplied to the lower ends of the cylinders 114, the upper ends of the cylinders 114 are open to a controlled exhaust system. As the rafter arms 44 are shortened, the support arms 42 upwardly pivot about their lower ends. As the support arms 42 upwardly pivot toward the side wall 14, the canopy 16 is furled onto the roller assembly 20 by the bias of the torsion spring 38. The rafter arms 44 continue to be shortened until they are retracted as best shown in FIG. 2.

Once the rafter arms 44 are retracted, pressurized fluid is supplied to the upper ends of the support arm pneumatic actuators 50 to begin retracting or shortening the support arms 42. It is noted that while pressurized fluid is supplied to the upper ends of the pneumatic actuators 50, the lower ends of the pneumatic actuators 50 are open to a controlled exhaust system. As the support arms 42 are shortened, they pivot upward toward the side wall 14 about their lower ends as the lower ends of the rafter arms 44 move toward the lower ends of the support arms 42. As the support arms 42 upwardly pivot toward the side wall, the canopy continues to be furled onto the roller assembly 20 under the bias of the torsion spring 38. The support arms 42 continue to be shortened until they are fully retracted, the lower ends of the rafter arm pneumatic actuators 114 are opened to a controlled exhaust, and the awning assembly 10 is in the fully retracted position as best shown in FIG. 1. Finally, pressurized fluid is exhausted from the pneumatic cylinder 185 of the lock mechanism 26 so that the spring 184 automatically pivots the lock member 182 to the locking position and the upper end of the support arm pneumatic actuators 50 are opened to a controlled exhaust.

It is apparent from the above description that the awning assembly 10 according to the present invention provides powered automatic means for opening the canopy 16 to an extended position, maintaining the canopy 16 in the extended position, setting and maintaining the canopy in a rain position, and retracting the canopy to a storage position and also includes non-powered automatic means for holding the awning assembly 10 in the stored position which overcomes most of the issues of the related art.

Although particular embodiments of the invention have been described in detail, it will be understood that the invention is not limited correspondingly in scope, but includes all changes and modifications coming within the spirit and terms of the claims appended hereto.

What is claimed is:

1. A retractable awning assembly for mounting to a vertical support surface, said awning assembly comprising:

a roller assembly;

a flexible canopy having an inner edge for connection to the support surface and an outer edge secured to said roller assembly;

a pair of arm assemblies supporting opposite ends of said roller assembly and operable to move said roller assembly between a stored position adjacent the support surface and a sheltered position spaced from the support surface, each of said arm assemblies having an extendable support arm, a powered actuator operably connected to said support arm for extending and retracting said support arm, and an extendable rafter arm, said support arm having at least one cam follower, an upper end operably connected to said roller assembly and a lower end pivotably securable to the support surface, said rafter arm having an upper end pivotably securable to the support surface and a lower end pivotally connected to said support arm, wherein said lower end of said rafter arm is pivotally connected to an upper member of said support arm at a fixed position;

at least one ramp having a cam surface adapted to cooperate with said cam follower to pivot said support arm about said lower end of said support arm when said support arm is extended while in the stored position; and a control system for selectively supplying power to said actuator to move said roller assembly between said stored position and said sheltered position.

2. The retractable awning assembly according to claim 1, wherein said ramp is generally wedge shaped.

3. The retractable awning assembly according to claim 1, wherein there are two of said ramps associated with each of said support arms and said ramps are laterally spaced apart a distance which allows said support arm to vertically extend therebetween.

4. The retractable awning assembly according to claim 3, wherein each of said support arms have a pair of laterally spaced apart cam followers.

5. The retractable awning assembly according to claim 1, wherein said at least one cam follower is a wheel.

6. The retractable awning assembly according to claim 1, wherein said support arm includes telescoping upper and lower members.

7. The retractable awning assembly according to claim 6, wherein said lower end of said rafter arm is pivotally connected near a lower end of said support arm upper member.

8. The retractable awning assembly according to claim 6, wherein said rafter arm includes at least one powered actuator for extending and retracting said rafter arm.

9. The retractable awning assembly according to claim 8, wherein said rafter arm includes a pair of parallel powered actuators for extending and retracting said rafter arm.

10. The retractable awning assembly according to claim 1, wherein said roller assembly includes a roller tube for furling and unfurling said canopy thereon and a torsion spring adapted to bias said roller tube to furl said canopy on said roller tube.

11. The retractable awning assembly according to claim 1, further comprising an automatic lock mechanism for holding the roller assembly in the stored position.

12. The retractable awning assembly according to claim 11, wherein said lock mechanism engages and holds without power applied thereto.

13. The retractable awning assembly according to claim 11, wherein said lock mechanism engages an upper wall connection of said rafter arm.

14. The retractable awning assembly according to claim 11, wherein an upper wall connection of said rafter arm in cooperation with end caps of said roller assembly incorporate means for preventing the furled canopy from billowing.

15. The retractable awning assembly according to claim 11, wherein said lock mechanism and said control system are adapted so that an operator must input an awning extension command to the control system before the lock mechanism releases the roller assembly.

16. The retractable awning assembly according to claim 1, further comprising an automatic mechanism for setting and holding the roller assembly in a rain position wherein one end of the roller assembly is held lower than the other end of the roller assembly.

17. The retractable awning assembly according to claim 1, wherein said control system is adapted so that an operator can input a rain position command to the control system to automatically activate the actuator of one arm assembly to partially retract the support arm and allow for drainage of rain water before an undesirable amount of water accumulates on the canopy surface.

18. A recreational vehicle comprising:

an exterior wall; and a retractable awning including:

a roller assembly;

a flexible canopy having an inner edge for connection to the wall and an outer edge secured to said roller assembly; and a pair of arm assemblies supporting opposite ends of said roller assembly and operable to move said roller assembly between a stored position adjacent the wall and a sheltered position spaced from the wall, each of said arm assemblies having an extendable support arm, a powered actuator operably connected to said support arm for extending and retracting said support arm, and an extendable rafter arm, said support arm having at least one cam follower, an upper end operably connected to said roller assembly and a lower end pivotably securable to the wall, said rafter arm having an upper end pivotably securable to the wall and a lower end pivotally connected to said support arm, wherein said lower end of said rafter arm is pivotally connected to an upper member of said support arm at a fixed position;

at least one ramp having a cam surface adapted to cooperate with said cam follower to pivot said support arm about said lower end of said support arm when said support arm is extended while in the stored position; and a control system for selectively supplying power to said actuator to move said roller assembly between said stored position and said sheltered position.

19. A retractable awning assembly for mounting to a vertical support surface, said awning assembly comprising:

a roller assembly;

a flexible canopy having an inner edge for connection to the support surface and an outer edge secured to said roller assembly;

a pair of arm assemblies supporting opposite ends of said roller assembly and operable to move said roller assembly between a stored position adjacent the support surface and a sheltered position spaced from the support surface, each of said arm assemblies having an extendable support arm, a powered actuator operably connected to said support arm for extending and retracting said support arm, and an extendable rafter arm including a pair of parallel powered actuators for extending and retracting said rafter arm, said support arm having an upper end operably connected to said roller assembly and a lower end pivotably securable to the support surface, said rafter arm having an upper end pivotably securable to the support surface and a lower end pivotally connected to said support arm; and a control system for selectively supplying power to said actuator of said support arm and said pair of actuators of said rafter arm to move said roller assembly between said stored position and said sheltered position.

20. The retractable awning assembly according to claim 19, wherein said support arm has at least one cam follower, and said awning assembly further comprises at least one ramp having a cam surface adapted to cooperate with said cam follower to pivot said support arm about said lower end of said support arm when said support arm is extended from the stored position.

21. The retractable awning assembly according to claim 19, wherein said support arm includes telescoping upper and lower members and said lower end of said rafter arm is pivotally connected to said upper member of said support arm at a fixed position.

22. The retractable awning assembly according to claim 21, wherein said lower end of said rafter arm is pivotally connected near a lower end of said support arm upper member.

23. The retractable awning assembly according to claim 19, wherein said pair of actuators of said rafter arm each include a sealed cylinder, a piston axially movable within said sealed cylinder, and a rod secured to and axially movable with said piston, and wherein said pistons of said pair of actuators are rigidly connected together.

24. The retractable awning assembly according to claim 19, wherein said roller assembly includes roller tube for furling and unfurling said canopy thereon and a torsion spring adapted to bias said roller tube to furl said canopy on said roller tube.

25. A recreational vehicle comprising:

an exterior wall; and a retractable awning including:

a roller assembly;

a flexible canopy having an inner edge for connection to the wall and an outer edge secured to said roller assembly;

a pair of arm assemblies supporting opposite ends of said roller assembly and operable to move said roller assembly between a stored position adjacent the wall and a sheltered position spaced from the wall, each of said arm assemblies having an extendable support arm, a powered actuator operably connected to said support arm for extending and retracting said support arm, and an extendable rafter arm including a pair of parallel powered actuators for extending and retracting said rafter arm, said support arm having an upper end operably connected to said roller assembly and a lower end pivotably securable to the wall, said rafter arm having an upper end pivotably securable to the wall and a lower end pivotally connected to said support arm; and a control system for selectively supplying power to said actuator of said support arm and said pair of actuators of said rafter arm to move said roller assembly between said stored position and said sheltered position.

26. A method of deploying a retractable awning including a pair of arm assemblies supporting opposite ends of a roller assembly and each having an extendable support arm and an extendable rafter arm, the support arm having an upper end operably connected to the roller assembly and a lower end pivotably secured to a wall, the rafter arm having an upper end pivotably secured to the wall and a lower end pivotally connected to the support arm, said method comprising:

extending the support arms until the support arms are fully extended; and retracting the rafter arms until the support arms are fully extended and extending the rafter arms after the support arms are fully extended.

27. The method according to claim 26, further comprising the step of pivoting said support arms about lower ends thereof by engaging ramps secured to the wall with cam followers secured to the support arms during said step of extending said support arms.

28. The method according to claim 26, wherein said step of extending said support arms includes supplying pressurized fluid to actuators of said support arms.

29. The method according to claim 28, wherein said step of extending said rafter arms includes supplying pressurized fluid to actuators of said rafter arms.

30. A retractable awning assembly for mounting to a vertical support surface, said awning assembly comprising:

a roller assembly;

a flexible canopy having an inner edge for connection to the support surface and an outer edge secured to said roller assembly;

a pair of arm assemblies supporting opposite ends of said roller assembly and operable to move said roller assembly between a stored position adjacent the support surface and a sheltered position spaced from the support surface, each of said arm assemblies having an extendable support arm, a powered actuator operably connected to said support arm for extending and retracting said support arm, and an extendable rafter arm, said support arm having at least one cam follower, an upper end operably connected to said roller assembly and a lower end pivotably securable to the support surface, said rafter arm having an upper end pivotably securable to the support surface and a lower end pivotally connected to said support arm, wherein said powered actuator is one of pneumatically powered and hydraulically powered;

at least one ramp having a cam surface adapted to cooperate with said cam follower to pivot said support arm about said lower end of said support arm when said support arm is extended while in the stored position; and a control system for selectively supplying power to said actuator to move said roller assembly between said stored position and said sheltered position.

* * * * *